US010352036B2

(12) United States Patent
Scotta et al.

(10) Patent No.: US 10,352,036 B2
(45) Date of Patent: Jul. 16, 2019

(54) DEVICE FOR COUPLING WALLS AND STRUCTURE COMPRISING SUCH DEVICE

(71) Applicant: UNIVERSITA' DEGLI STUDI DI PADOVA, Padua (IT)

(72) Inventors: Roberto Scotta, Padua (IT); Luca Pozza, Padua (IT); Davide Trutalli, Padua (IT); Luca Marchi, Padua (IT)

(73) Assignee: Universita' Degli Studi Di Padova, Padua (IT)

( * ) Notice: Subject to any disclaimer, the term of this patent is extended or adjusted under 35 U.S.C. 154(b) by 0 days.

(21) Appl. No.: 15/748,047

(22) PCT Filed: Jul. 20, 2016

(86) PCT No.: PCT/IB2016/054304
§ 371 (c)(1),
(2) Date: Jan. 26, 2018

(87) PCT Pub. No.: WO2017/017563
PCT Pub. Date: Feb. 2, 2017

(65) Prior Publication Data

US 2018/0216337 A1 Aug. 2, 2018

(30) Foreign Application Priority Data

Jul. 28, 2015 (IT) ..... UB2015A2555

(51) Int. Cl.
*E04B 1/38* (2006.01)
*E04B 1/41* (2006.01)
*E04B 1/26* (2006.01)

(52) U.S. Cl.
CPC ..... *E04B 1/40* (2013.01); *E04B 1/2604* (2013.01); *E04B 2001/2644* (2013.01); *E04B 2001/2648* (2013.01); *E04B 2001/405* (2013.01)

(58) Field of Classification Search
CPC .... E04B 1/40; E04B 1/2604; E04B 2001/405; E04B 2001/2644; E04B 2001/2648;
(Continued)

(56) References Cited

U.S. PATENT DOCUMENTS 2,868,146 A 1/1959 Mackintosh
4,794,746 A * 1/1989 Ramer ..... E04B 5/12 52/695
2007/0186503 A1 8/2007 Homma et al.

FOREIGN PATENT DOCUMENTS

WO WO 98/09030 A 5/1998

OTHER PUBLICATIONS

Seimens Bauunion G M B H Komma, "Connecting Means for Points of Junction in Trusted Framework and Like Structures patent specification", GB 292,817, Jun. 28, 1928 (6 Pages).
(Continued)

*Primary Examiner* — Patrick J Maestri
(74) *Attorney, Agent, or Firm* — Mark Malek; Paul Ditmyer; Widerman Malek, PL

(57) ABSTRACT

The present invention relates to an anchoring device for walls, comprising a plate-shaped metal element, and a plurality of holes passing through the plate-shaped metal element adapted to house elements fastening the plate-shaped metal element to a first and a second wall. The plate-shaped metal element has a substantially "X" geometrical shape with four curved arms that converge in a central connecting portion and comprises at least two holes on two distinct arms.

20 Claims, 5 Drawing Sheets

(58) Field of Classification Search
CPC ..... E04B 2001/2415; E04B 2001/2692; E04B 2001/2696
USPC ..... 248/300, 301, 220.21, 220.31, 220.41; 52/582.1, 657, 715; 403/346
See application file for complete search history.

(56) References Cited

OTHER PUBLICATIONS

International Bureau, "International Search Report and Written Opinion for related Application Serial No. PCT/IB2016/054304", dated Nov. 25, 2016 (12 Pages).
International Bureau, "Published Application for related Application Serial No. WO 2017/017563 A1", published with WIPO on Feb. 2, 2017 (34 Pages).

* cited by examiner

Graph A

Graph B

Graph C

Graph D

Graph E

Graph F

Table 3: Alnalysis of axial load tests (according to EN 12512).

| | Test 1 | Test 2 | Test 3 | Average | SD |
|---|---|---|---|---|---|
| $F_y$ [kN] | 17.55 | 18.37 | 17.99 | 17.97 | 0.36 |
| $V_y$ [mm] | 1.89 | 2.01 | 1.98 | 1.96 | 0.06 |
| $F_u$ [kN] | 37.18 | 37.84 | 38.25 | 37.76 | 0.48 |
| $V_u$ [mm] | 44.30 | 47.30 | 47.00 | 46.20 | 1.48 |
| $k_{el}$ [kN/mm] | 9.31 | 9.12 | 9.08 | 9.17 | 0.11 |
| $k_{pl}$ [kN/mm] | 0.46 | 0.43 | 0.45 | 0.45 | 0.01 |
| $\mu$ ($V_u$) [-] | 23.49 | 23.49 | 23.72 | 23.57 | 0.12 |
| Ductility Class | H | H | H | H | - |

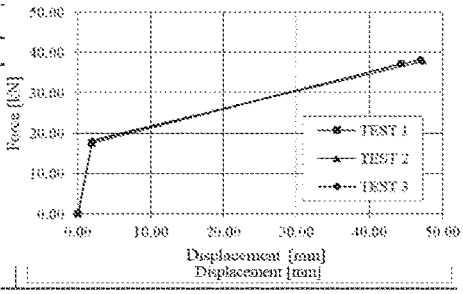

Table 1

Table 4: Alnalysis of shear load tests (according to EN 12512).

| | Test 1 | Test 2 | Test 3 | Average | SD |
|---|---|---|---|---|---|
| $F_y$ [kN] | 26.71 | 29.41 | 28.14 | 28.09 | 1.21 |
| $V_y$ [mm] | 2.38 | 4.00 | 4.02 | 3.46 | 0.84 |
| $F_u$ [kN] | 29.00 | 29.70 | 28.40 | 29.03 | 0.58 |
| $V_u$ [mm] | 50.00* | 58.00* | 80.00 | - | - |
| $k_{el}$ [kN/mm] | 11.24 | 7.36 | 7.00 | 8.53 | 2.10 |
| $k_{pl}$ [kN/mm] | 0.05 | 0.01 | 0.00 | 0.02 | 0.02 |
| $\mu$($V_u$=50mm) | 21.04 | 12.51 | 12.44 | 15.33 | 4.42 |
| Ductility Class | H | H | H | H | - |

*Nei test 1 e 2 non è stato raggiunto lo spostamento ultimo per limitazioni del setup.

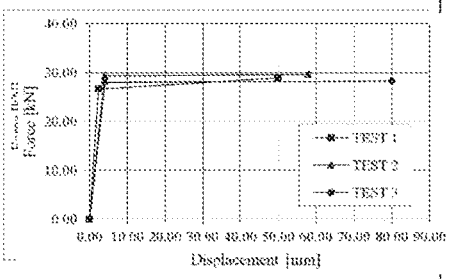

Table 2

Table 5: Analysis of shear load tests (EEEP method)

| | Test 1 | Test 2 | Test 3 | Average | SD |
|---|---|---|---|---|---|
| $F_y$ [kN] | 27.41 | 28.88 | 27.83 | 28.04 | 0.68 |
| $V_y$ [mm] | 2.60 | 4.45 | 4.53 | 3.86 | 0.98 |
| $F_u$ [kN] | 27.41 | 28.88 | 27.83 | 28.04 | 0.68 |
| $V_u$ [mm] | 50.00* | 58.00* | 80.00 | - | - |
| $k_{el}$ [kN/mm] | 10.55 | 6.49 | 6.14 | 7.73 | 2.19 |
| $k_{pl}$ [kN/mm] | 0.00 | 0.00 | 0.00 | 0.00 | 0.00 |
| $\mu$($V_u$=50mm) | 19.24 | 11.24 | 11.03 | 13.84 | 4.19 |
| Ductility Class | H | H | H | H | - |

*Nei test 1 e 2 non è stato raggiunto lo spostamento ultimo per limitazioni del setup.

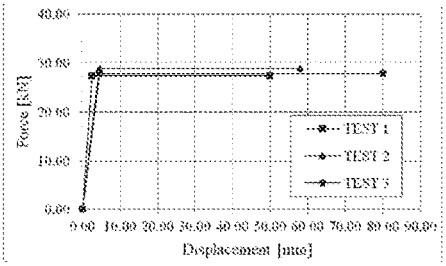

Table 3

Fig.10

DEVICE FOR COUPLING WALLS AND STRUCTURE COMPRISING SUCH DEVICE

CROSS REFERENCE TO RELATED APPLICATIONS

This is a national stage application under 35 U.S.C. § 371 of PCT patent application PCT/IB2016/054304, filed on Jul. 20, 2016, which claims the benefit of UB2015A002555, filed on Jul. 28, 2015, each of which is hereby incorporated by reference in its entirety.

TECHNICAL FIELD

The present invention relates to the building field, particularly to systems for coupling walls of buildings.

The present invention particularly relates to metal plate devices for anchoring or connecting walls according to the preamble of claim 1 and to structures comprising such devices.

PRIOR ART

In the building field, recently, interest in wood as a building material has experienced a considerable increase.

It is more and more common to build structures and buildings equipped with load-bearing walls (or even panels) made of wood, where the system for connecting such walls (or panels) with the foundation is accomplished by means of anchoring metal devices.

Such connection system has two functions: it prevents both shear displacement and overturning of the structure with respect to the foundation from occurring, which result from horizontal (static or seismic) forces acting in the same plane of the wall and generally on the whole building.

Overturning is generally resisted by anchoring devices that provide two distinct portions bent at right angle with each other, elongated in the portion fastened to the wall, commonly called as hold-down.

Hold-downs are designed to operate by tensile force and are connected to wood walls by means of nails or screws and to the foundation by threaded bars made of steel, inserted into holes typically sealed with cement mortar or epoxy mortar.

Shear displacement is resisted by angle brackets, which are bent obtaining portions of similar size, generally made of steel, connected to the wall by nails or screws and to the foundation by wood screws, and are arranged along the corner of the wall in contact with the foundation.

A first drawback related to the use of conventional brackets is found in presence of combined stresses of the shear-tensile type, very common in usual structures. For such loading conditions the individual devices just described do not guarantee optimal performances, since they are specifically designed for one or the other type of stress.

Even if properly stressed conventional devices have other types of drawbacks.

Firstly when they are properly designed for failure on nail or screw side, therefore with a failure of the ductile type, the cyclic deformation of such fastening elements causes embedment of wood with a progressive loss of efficacy in the connection. Such phenomenon, known as "pinching" reduces strength and dissipative capacity of the system.

Secondly they can often be subjected to an undesired and unexpected failure of the brittle type. This occurs in connections with dense nails due to a too much precautionary evaluation provided by EC5 standard about screws or nails strength.

Actually screws and nails have strength capacities higher than theoretical ones and this can move the connection failure to the side of the perforated metal plate, or even worse, to the side of the connection towards the concrete (joints with mechanical or chemical anchors).

Such drawbacks can occur both in wall-foundation connections and in walls-floors and walls-walls connections.

Conventional hold-down and angle brackets are characterized by reduced ductile and/or dissipative capacities, assigned only to nails or screws. Accordingly current seismic standards, both national and European, classify structures with wood walls, whose dissipative capacity is assigned only to such conventional connections, as structures having a low dissipative capacity.

A further drawback, even if maybe less perceived than the previous ones, about known connection devices is the process for manufacturing them, since generally their production involves several operations, involves high scraps, requires welding that is expensive and can give rise to brittle failures.

Still another drawback of known solutions is the fact of having necessarily available at least two different types of anchoring devices (hold-down and angle brackets) depending on the type of stress to be absorbed (tensile and stress respective).

OBJECTS AND SUMMARY OF THE INVENTION

It is an object of the present invention to overcome prior art drawbacks.

Particularly it is an object of the present invention to provide a device for coupling walls with dissipative functions both for shear and tensile stresses.

It is also an object of the present invention to provide a device for anchoring or connecting walls optimizing energy dissipation and ductility of the connection of walls, due to the diffuse plasticization of the metal plate and to the reduction in the wood embedment phenomenon, typical of conventional connectors.

It is also an object of the present invention to provide an anchoring device for walls that, is inexpensive and of rapid and efficient production.

These and other objects of the present invention are achieved by, an anchoring or connecting device for walls embodying the characteristics of the annexed claims, which are an integral part of the present description.

The idea at the base of the present invention provides to manufacture a device for anchoring or connecting walls, comprising a plate-shaped metal element and a plurality of holes passing therethrough and adapted to house elements fastening the plate-shaped metal element to a first and a second wall.

Such device therefore can be used both as a system for the anchorage to the base of walls and as a system for the connection of walls; in both the cases the device has characteristics withstanding static and/or seismic actions.

According to a characteristic of the present invention the plate-shaped element has a substantially "X" geometrical shape with four curved arms that converge in a central connecting portion and it provides at least two holes on two distinct arms thereof.

Such solution allows the anchoring device to be provided with high efficiency in terms of resistance to stresses exerted on the structure where it is installed since, the particularly geometry of its shape, allows the device to withstand combined tensile and shear stresses.

Moreover such geometry further involves an improvement in the dissipative efficiency of the device since, even if maintaining high stiffness and strength values, it gives to the device a plastic behavior with wide hysteresis cycles and high ductility values, reducing to a minimum the "pinching" phenomena and transferring the dissipative function from the fastening elements to the plate-shaped element.

In a preferred embodiment each arm of the anchoring device has an appendage curved towards the central portion forming a cove with the respective arm, which has a perimetral edge complementary with the profile of the appendage.

Such solution promotes the rapidity in the production and the cheapness of the anchoring device, since the particular symmetry of its shape reduces to a minimum the necessary treatments and scraps, it being possible to advantageously produce a plurality of devices starting from a single metal plate that is suitably cut.

The invention further relates to a structure comprising a first and second wall, connected by at least one device described in the present description.

Further advantageous characteristics of the present invention will be more clear from the following description and from the annexed claims, which are an integral part of the present invention.

BRIEF DESCRIPTION OF THE DRAWINGS

The present invention will be described below with reference to non-limitative examples provided by way of example and not as a limitation in the annexed drawings. These drawings show different aspects and embodiments of the present invention and, where appropriate, reference numerals showing like structures, components, materials and/or elements in different figures are denoted by like reference numerals.

FIG. 10 is the tables for interpreting the results of experimental tests carried out for verifying the efficiency of the suggested anchoring device.

DETAILED DESCRIPTION OF THE INVENTION

While the invention is susceptible of various modifications and alternative forms, some non-limitative embodiments, given by way of example, are described herein below in details.

It should be understood, however, that there is no intention to limit the invention to the specific embodiments disclosed, but, on the contrary, the intention of the invention is to over all modifications, alternative constructions and equivalents falling within the scope of the invention as defined in the claims.

Therefore, in the description below, the use of "for example", "etc", "or" indicates non-exclusive alternatives without limitation unless otherwise defined; the use of "also" means "among which, but not limited to", unless otherwise defined; the use of "include/comprise" means "include/comprise, but not limited to," unless otherwise defined.

References to "upper", "lower", "above", "under" and the unless otherwise specified, have to be intended with respect to an operating condition that is with the device in the mounted condition.

Here and in the claims below the term "walls" means vertical or horizontal elements of a structure whose thickness is reduced with respect to their width and/or length.

The term "coupling" denotes both "anchorages" at the base of vertical walls with horizontal structures and "connections" between adjacent walls.

Figure 1:
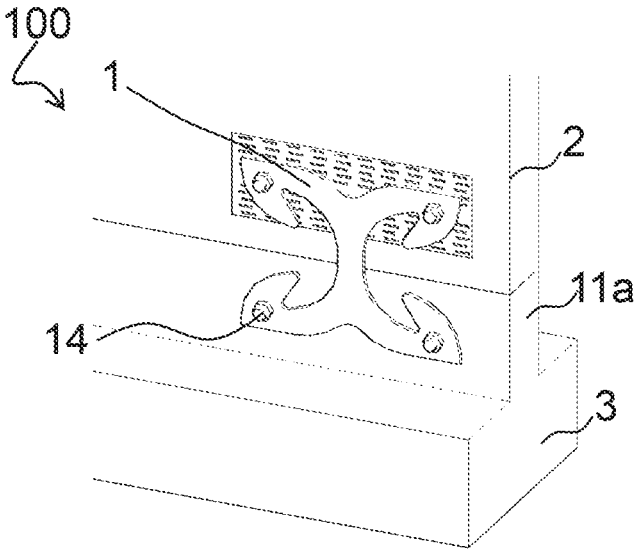
FIG. 1 is a view of an application system of a first embodiment of an anchoring device according to the invention.

FIG. 1 shows a structure 100 comprising a device 1 according to the invention for anchoring two walls 2, 3.

The shown device 1 is a first embodiment, variants will be disclosed below with reference to FIG. 5, 6.

In the embodiment shown in FIG. 1, in a non-limitative manner, the wall 2 is a wood wall and the other wall is a foundation element 3 of the structure.

In other embodiments the wall 2 is made of a material different than wood, for example concrete, fiber-reinforced materials and the like.

Figure 4A:
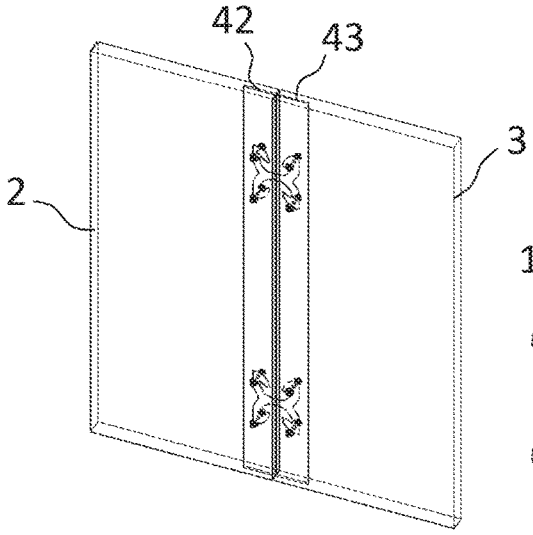
FIGS. 4A and 4B are the device according to the first embodiment, installed for joining together two panels.
Figure 4B:
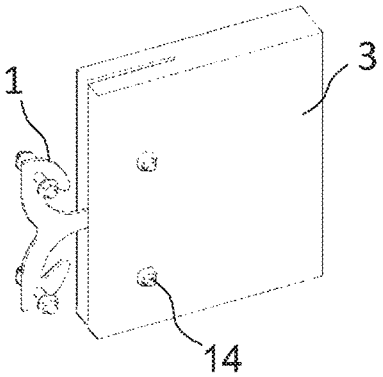

It is specified that, as shown in FIGS. 4A and 4B, the two walls may be made of another material, for example wood, concrete, composite or fiber-reinforced material, steel and the like, also different from each other.

With reference again to FIG. 1, the structure, to which the invention further relates, comprises a foundation 3 comprising a ledge 11*a* protruding substantially vertically from the foundation 3; preferably foundation and ledge are made of reinforced concrete or as an alternative the ledge is made of wood of the durable type, in order to avoid wood ledge and foundation from being in direct contact. In this case the connection between the wood ledge and the concrete foundation is obtained by chemical or mechanical anchors, or also by screws self-threading on the concrete.

In other embodiments the ledge is absent: in this case the foundation goes out from the ground level and it has a substantially vertical accessible wall.

Anyway such as seen in the embodiment shown in FIG. 1 it is clear that the device 1 allows a wall 2 to be connected with the foundation 3 of a structure.

Figure 2:
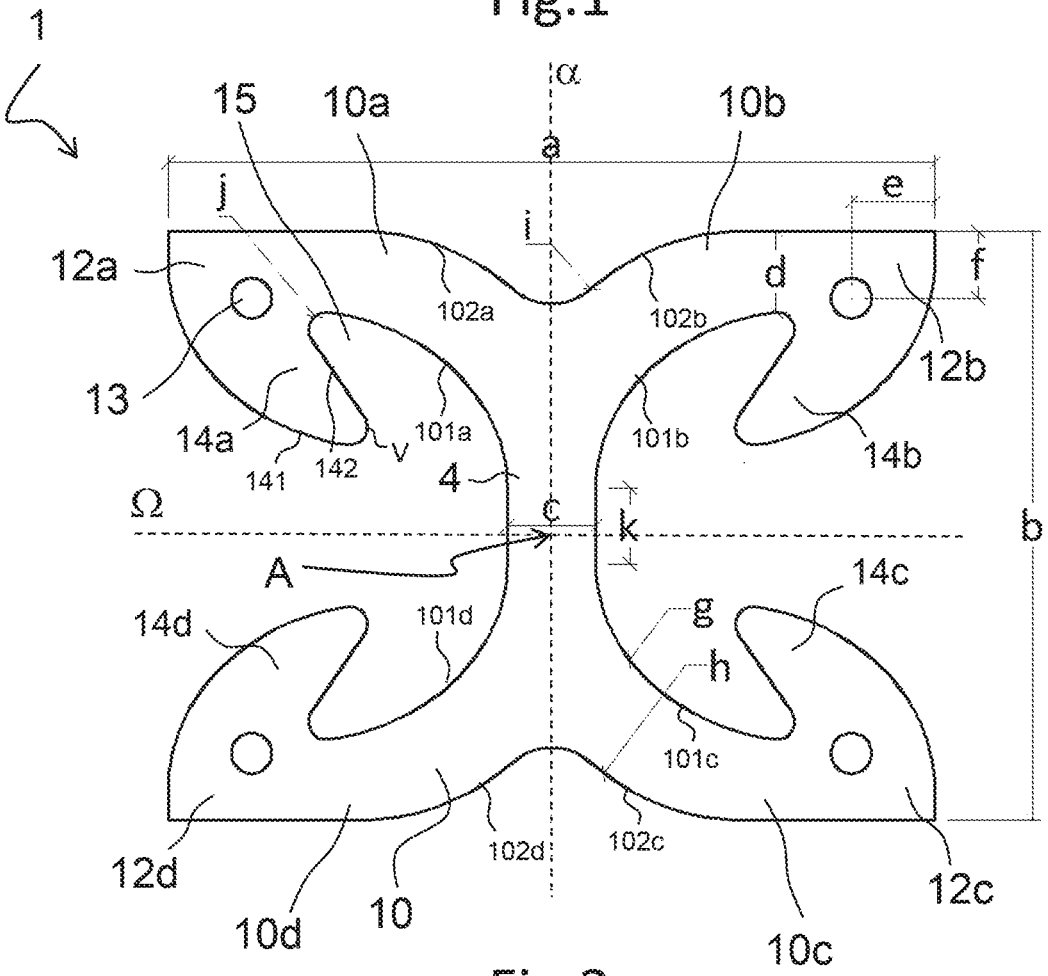
FIG. 2 is a view from the front of the first embodiment of the plate-shaped element according to the invention.

With reference to FIG. 2 the device 1 comprises a plate-shaped element 10 with a flat geometry, that in the preferred embodiment of the invention is made of structural steel, preferably S275 steel, but not exclusively since it is possible to use also other materials with a suitable strength and ductility.

In a preferred embodiment the material is a structural steel such as the one provided by the current standard EN-10027-1.

The plate-shaped element 10 is shaped such that its geometry has a substantially "X" shape.

In particular the plate 10 comprises four curved arms 10*a*, 10*b*, 10*c*, 10*d* that, through a respective inner edge 101*a*,

101*b*,101*c*,101*d* and an outer edge 102*a*,102*b*,102*c*,102*d* converge in a central connecting portion 4 of the plate-shaped element 10.

The central portion 4 develops along a first longitudinal plane of symmetry α of the device intercepting a second plane of symmetry Ω transverse to the device and perpendicular to the plane α.

The first longitudinal plane of symmetry α of the device intercepts the second plane of symmetry Ω along a line passing through the central portion 4.

Said line of interception is normal to the plane of the plate-shaped element 10 and in particular it passes through the geometric center of the device.

In the preferred embodiment the four arms 10*a*, 10*b*, 10*c*, 10*d* have central symmetry with respect to the geometric center and, with the device in the applied condition, it is arranged such that, as seen in FIG. 1, a first pair of (consecutive) arms 10*a*, 10*b* is in contact with the first wall 2, a second pair 10*c*, 10*d* of consecutive arms, and different from the first pair, is in contact with a foundation ledge 11*a* or as an alternative with a second wall.

Moreover when installed on the structure, preferably the central connecting portion 4 is orthogonal to the contact profiles of the first wall 2 and of the ledge 11*a*, or of the second wall: that is to say,—preferably—the longitudinal development of the central portion 4 is perpendicular to the line of connection between two panels (or between panel and ledge). Under different operating conditions, it is also possible to provide the device 1 to be mounted such that the longitudinal development of the central portion 4 is parallel to such line of connection, obtaining a stiffer behavior of the device as regards tensile stresses, but an equally efficient behavior as regards shear stresses. The central portion 4 of the plate 10 has a width, taken at the transversal plane Ω, equal to c and the profile of each arm, coming out from such central portion, as mentioned above, has an inner edge and an outer edge.

In particular each outer edge 102*a*,102*b*,102*c*,102*d* is connected to the central portion 4 following a pattern having a radius of curvature z according to relation h=2.61*c while each inner edge 101*a*,101*b*,101*c*,101*d* is connected to the central portion following a radius of curvature g that determines the profile of an ellipse having a semi-major axis $g_1$=2.42* and semi-minor axis $g_2$=2.01*c.

Upon reaching a substantially parallel pattern of the profile of the two edges—in particular when such edges are further parallel to the transverse plane Ω—each arm has an end (12*a*, 12*b*, 12*c*, 12*d*) whose width d from the inner edge to the outer edge preferably is equal to c=0.91*d.

At each end, in the first embodiment, there is further provided a hole 13, intended to house elements 14 for fastening the plate to the walls (see FIG. 1).

The hole preferably has a circular shape and its central axis is orthogonal to the plane of the plate.

Fastening elements preferably are threaded fastening elements, such as for example bolts, but in other embodiments they can be nails or screws, suitably dimensioned on the basis of the type of material they have to engage.

Preferably, but not exclusively, bolts are M12, M14 or M16 made of steel of the 8.8 or 10.9 type.

The geometric center of the holes is at an horizontal distance e=0.94*c from the point of maximum transverse extension of the arms, and at a distance f=0.75*c from the outer edge; this allows also localized failure phenomena to be prevented.

Preferably at each end 12*a*, 12*b*, 12*c*, 12*d* the arms have an appendage 14*a*, 14*b*, 14*c*, 14*d* which is curved towards the central portion 4 and it is oriented towards point A. Each appendage has two sides, an inner side 142, facing the inner edge 101*a*, 101*b*, 101*c*, 101*d* of the respective arm, and an outer side 141, which converge to a common vertex V.

Particularly each inner side 142 of each appendage is joined to the inner edge of a respective arm, forming a cove 15 and their connection is formed with a radius of curvature j variable from 0.18*c<j<0.22*c, preferably equal to j=0.2*c.

Figure 3:
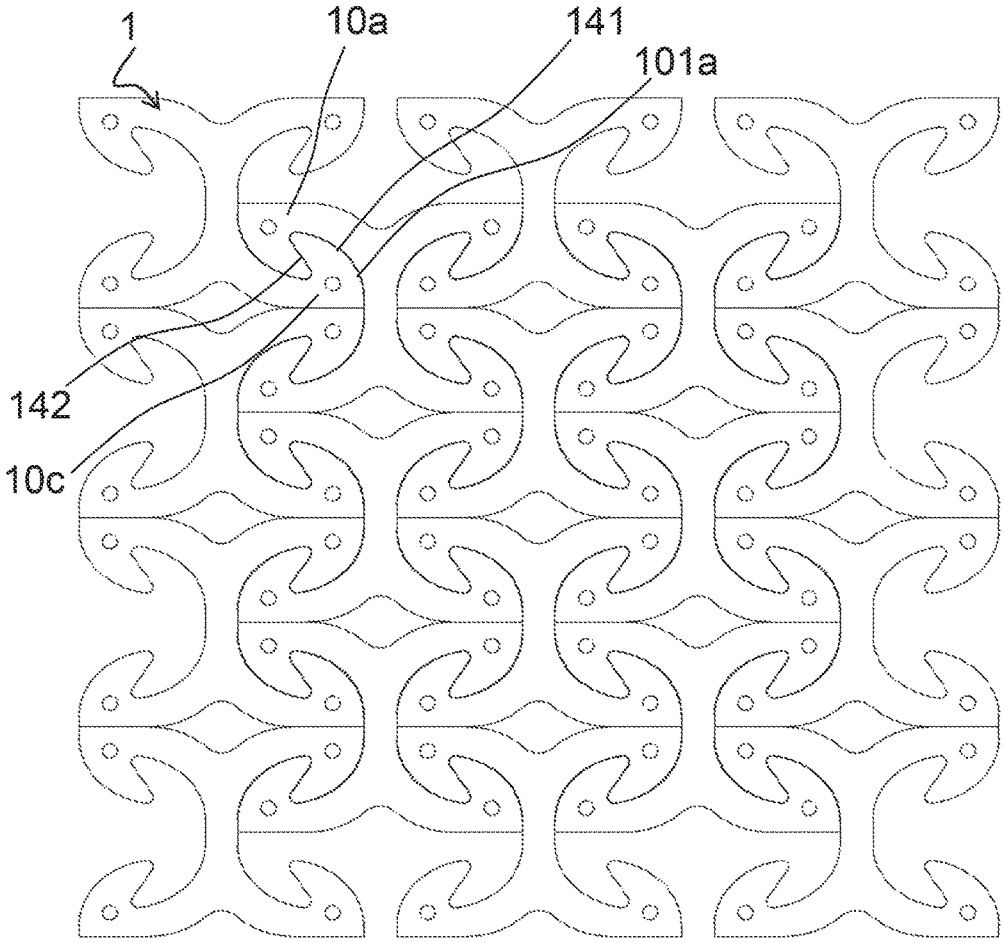
FIG. 3 is a plan view of a plurality of plate-shaped elements according to the first embodiment during a manufacturing step.

The cove formed in this manner defines an area delimited by a perimetral edge that is complementary to the profile of the appendage, such that, such as shown in FIG. 3, for each device 1 it is possible to fit in each cove 15 an appendage of an identical further device by a form-fit.

This clearly allows several devices to be produced starting from the same common plate, with advantages in reducing scraps and the amount and economy of cutting operations.

With reference again to FIG. 2, the outer edges 102*a*, 102*b* of two consecutive arms 10*a*, 10*b*, and symmetrical with respect to the longitudinal plane of symmetry α, are connected, at such axis, forming a depression that sinks into the central portion 4, and whose vertex has a radius of curvature according to the proportion i=0.67*c. The outer edges of such arms further determine the maximum extension a of the device along the transverse plane Ω, and such dimension is according to the relation a=8.66*c. On the contrary the distance of two points on the outer edges 102*a*, 102*d* of two consecutive arms and symmetric to the transverse plane of symmetry Ω, taken at their substantially straight pattern, determines the maximum extension b of the device along the longitudinal plane α, and it is according to relation b=6.66*c.

It results also that the thickness s of the plate preferably is determined by the relation s=0.17*c.

From the above description it is clear how the anchoring device described allows the above objects to be achieved.

This will be shortly clearer in the description of the performed experimental tests.

It is clear for a person skilled in the art that it is possible to make changes and variants to the solution described with reference to the above figures without for this reason departing from the scope of protection of the present patent as defined by the annexed claims. It is possible to vary one or more of the relations among the dimensional parameters just described, to emphasize different properties of the plate. For example it is possible to increase the maximum transverse extension a of the device 1 with respect to its width c, such to increase its capacity of maximum tensile displacement, or to increase the maximum longitudinal extension b in order to increase the capacity of maximum shear displacement of the device 1. Moreover it is possible to provide solutions not having a central symmetry.

A different type of application of the device 1 is shown in FIG. 4 and it allows two adjacent walls to be horizontally connected.

To this end, the device is inserted such to be concealed into two notches 42, 43 each one formed in the contact thicknesses of two distinct walls 2, 3.

Also in such arrangement the device is preferably arranged such that its longitudinal axis α is oriented perpendicularly to the contacting profiles of two walls. The fastening elements 14 preferably pass through the thickness of each wall engaging a respective hole 13 of the device 1.

In a completely similar manner, but not shown in the figures, the horizontal connection of two adjacent walls can be also obtained by arranging two anchoring devices.

The two devices are mirror-like arranged, more in details, such that each one connects adjacent faces of opposite sides of the two walls in contact. Therefore the fastening elements pass through the thickness of the walls and engage aligned axes of the two devices.

In some variants the devices are not arranged in a mirror-like manner and/or are placed only on one side of the wall.

In a further embodiment the device allows a wall 2 to be connected to a floor 20 of a structure.

Figure 6:
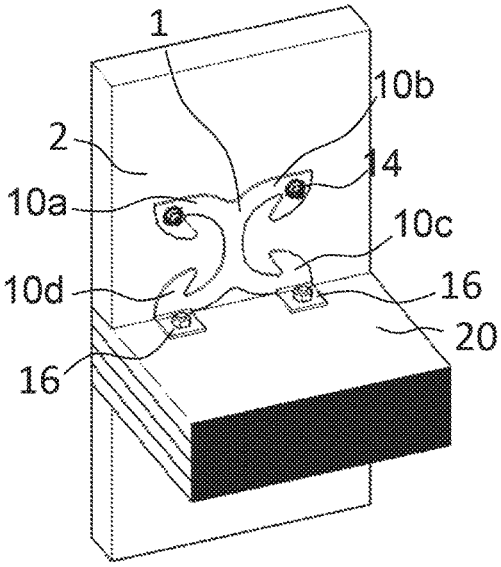

Such as seen in FIG. 6 to this end only two of the four ends 12*a*, 12*b*, 12*c*, 12*d* of the supporting arms provide holes for housing the fastening elements.

More in details, from each of the outer edges 102*c*,102*d* of two consecutive arms 10*c*,10*d* and symmetric relative to the longitudinal plane of symmetry α, at the ends not provided with holes, a metal plate 16 protrudes, orthogonally to the plane of the plate-shaped element 10.

The metal plate preferably is made of the same material as the plate-shaped element 10 and it is welded thereto. Each metal plate is further provided with a hole to allow fastening elements 14 to be inserted in the plate and engage the floor 20, while the remaining arms 10*a*,10*b* of the plate-shaped element are those with the holes that allow fastening elements to be inserted in the wall 2 orthogonal to the floor 20.

Figure 5:
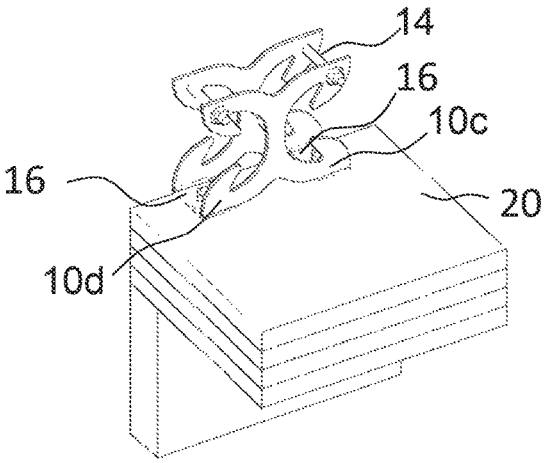
FIGS. 5 and 6 are a variant embodiment of the device according to the invention in the installed condition, particularly between vertical panels and a floor.

In a variant of such embodiment shown in FIG. 5 there is provided to use a first and a second device, arranged in a mirror-like manner.

In this case each metal plate of each device is welded to the outer edges of the two consecutive arms, arranged in a mirror-like manner and symmetrical manner with respect to the longitudinal plane of symmetry α.

In other embodiments not shown in the figures, the device 1 allows also panels of the floor of a structure to be connected. In this case the device is inserted into notches not necessarily so as to be concealed.

EXPERIMENTAL TESTS

Some tests are disclosed below showing the efficiency of the suggested device, particularly tests carried out on a device having a maximum transverse extension of a=303 mm, maximum longitudinal extension b=233 mm and a thickness equal to s=6 mm.

Parametric Analysis by FEM

Numeric simulations by finite element models (FEM) have been separately implemented for only-shear and only-tensile cyclic loading condition.

In a first step of the analysis push-over tests have been only carried out for determining the force-displacement curve for monotonic test and to obtain only the maximum resistance force developed by the device. Still in the first step of the push-over analysis also the possible local instability phenomena of the device have been constantly monitored.

Figure 7:
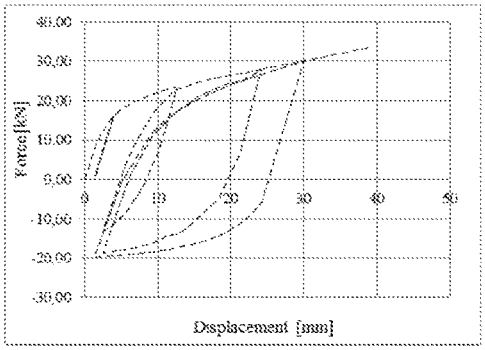
FIGS. 7, 8 and 9 are the results of finite element numerical tests and experimental tests carried out for verifying the efficiency of the suggested anchoring device.
Figure 7:
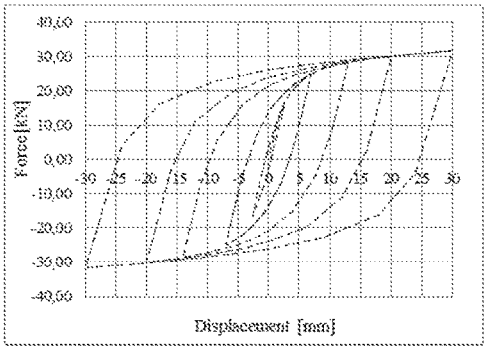

In a second step the hysteresis behavior of the device has been studied by simulations of cyclic load tests under displacement control. FIG. 7 shows the graphs of the resulting hysteresis cycles for only-tensile (graph A) and only-shear (graph B) cyclic load conditions. The device exhibited a good hysteresis behavior characterized by good strength and stiffness values and high ductility values.

Experimental Tests

Experimental tests have been carried out by designing two test configurations, that is only-tensile and only-shear tests. The tensile test simulates the condition of the device placed at the ends of the wall, that is in locations where the uplift action is more considerable. The only-shear test simulates the behavior of the device placed in the central part of the wall where horizontal displacement phenomena are considerable. The number of tested specimens is equal to 3 for each test configuration. Each specimen is composed of two samples, contemporaneously stressed, such to obtain symmetric load conditions. The total number of samples therefore is equal to six for each configuration and the results obtained from each specimen have to be intended as the experimental mean of two samples. Experimental cycles have been obtained by tests applying force under displacement control, according to test protocol provided by the standard EN12512.

Plate Subjected to Tensile Stress

Figure 8:
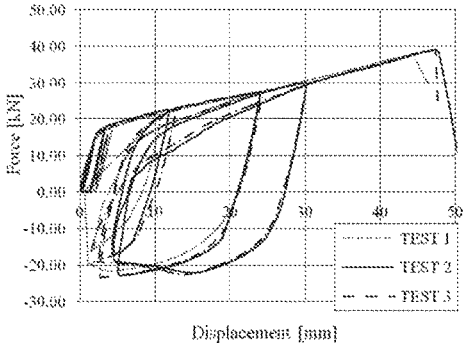
Figure 8:
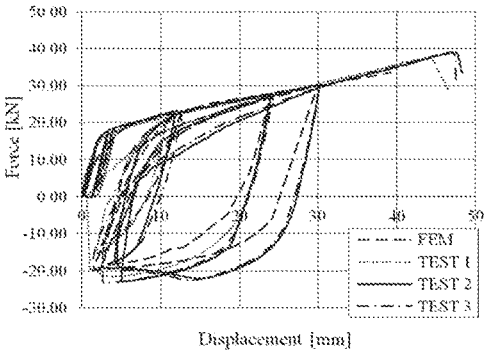

Graphs C and D of FIG. 8 show hysteresis cycles experimentally obtained and the comparison with the numerical model obtained by FEM analysis. Hysteresis cycles refer to a single device.

Plate Subjected to Shear Stress

Figure 9:
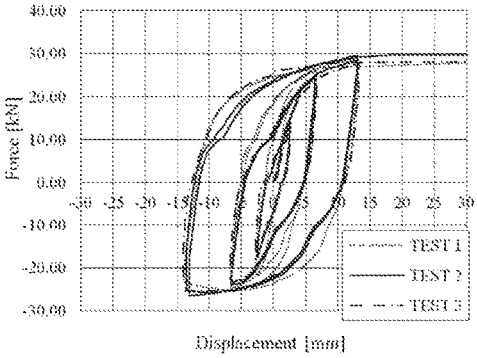
Figure 9:
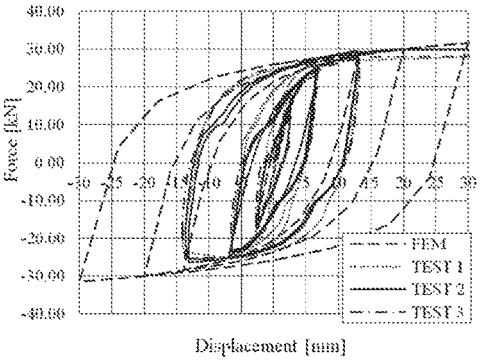

Graphs E and F of FIG. 9 show hysteresis cycles experimentally obtained and the comparison with the numerical model obtained by FEM analysis. Hysteresis cycles refer to a single device.

Load-displacement curves resulting from experimental tests allow main mechanical parameters to be obtained for the complete seismic characterization of the device of interest. Such parameters have been obtained according to instructions of standard EN 12512 (CEN 2006), by the analysis of hysteresis cycles and of the relevant envelope monotonic curve. In details, it has been possible to estimate failure forces and displacements ($F_u$, $V_u$) and yield forces and displacements ($F_y$, $V_y$), elastic stiffness $k_{el}$ and post-elastic stiffness $k_{pl}$ and ductility μ (FIG. 10—Tables from 1 to 3).

Experimental results clearly show that the anchoring device is characterized by a high starting stiffness value and by good shear and tensile strength values. The main result is the high value reached for ultimate displacement and ductility, that allow both the tested configurations to be classified in a high ductility class.

A further important aspect is the similar response of the device to two load conditions: stiffness, strength and ductility are comparable for the two tested configurations.

As regards tensile resistance, from the comparison with a typical hold-down, it provides an approximately two-times higher ultimate displacement and an eight-times higher ductility. From the comparison with a typical angle bracket subjected to shear action, considering for device an ultimate displacement of 80 mm, it results a two-times higher displacement capacity and a nine-times higher ductility. The results as regards strength are similar for conventional plates and for the device of interest, for both the load conditions. As regards elastic stiffness it reaches a four-tines higher value with respect to the conventional angle bracket subjected to shear action. Such comparisons show how it has been possible to considerably improve ductility values, and consequently the dissipative capacity, with respect to conventional connectors, by means of the particular shape used. The reason for such phenomenon is assigned to the capacity of steel to get deformed and to dissipate seismic energy. Such function is accomplished by the several parts of the plate, that is by the supporting arms and by the central connection portion. Cylindrical leg connectors (bolts) used for the connection with wood and foundation are not asked for any type of contributions to dissipation, since they are designed as having "overstrength" with respect to the ductile element, represented by the device itself. Such requirement fully verifies the hierarchy criteria of strength suggested by modern seismic standards. Moreover from an analysis of the hysteresis cycles it is possible to observe how the "pinching" phenomenon is completely absent, which is typical of conventional steel-wood and wood-wood connections. The resulting higher wideness of hysteresis cycles of the device of interest allows a greater energy dissipation to be obtained in case of earthquake.

The invention claimed is:

1. A device for coupling walls, comprising:

a plate-shaped metal element;

a plurality of holes passing through said plate-shaped metal element configured to receive fastening elements that fasten the plate-shaped metal element to a first and a second wall;

wherein the plate-shaped metal element has an geometrical shape with four curved arms that converge in a central connecting portion and includes a respective hole, of the plurality of holes, in at least two of the four curved arms; and wherein each of said four curved arms comprises a respective inner edge and outer edge connecting to the central connecting portion, wherein said central connecting portion has a width c at the transverse plane of symmetry, wherein said inner edge develops by following a radius of curvature g that determines the profile of an ellipse having semi-major axis $g_1$ such that $2.18*c<g_1<2.66*c$ and semi-minor axis $g_2$ such that $1.8*c<g_2<2.2*c$, and wherein said outer edge develops by following a radius of curvature h such that $2.35*c<h<2.87*c$.

2. The device according to claim 1, wherein said plate-shaped element has two planes of symmetry, a longitudinal plane of symmetry and a transverse plane of symmetry respectively, wherein said planes of symmetry intercept along a line of interception passing through said central connecting portion.

3. The device according to claim 2, wherein said four curved arms have symmetry with respect to a geometric center of the device.

4. The device according to claim 1, wherein $h=2.61*c$.

5. The device according to claim 4, wherein each of said four curved arms has an end of a width d, wherein said width d is the distance between a respective of said inner and outer edge, measured at the point where said edges are parallel to the transverse plane Ω, such that $0.82*c<d<1.00*c$.

6. The device according to claim 5, wherein the geometric center of each hole is placed at a distance e such that $0.85*c<e<1.03*c$, preferably $e=0.94$ c from the point of maximum transverse extension of the arms, and at a distance f such that $0.68*c<f<0.83*c$.

7. The device according to claim 1, wherein on each end of said curved arms one of said holes is formed.

8. The device according to claim 6, wherein each curved arm, at said ends, has an appendage which is curved towards the central portion and has a profile that comprises an inner side and an outer side converging in a vertex oriented towards the geometric center.

9. The device according to claim 8, wherein each appendage is joined with the inner edge of a respective arm forming a respective cove, wherein said cove has a radius of curvature j such that $0.18*c<j<0.22*c$.

10. The device according to claim 9, wherein said cove has a perimetral edge that is complementary to the profile of the appendage.

11. The device according to claim 10, wherein two consecutive arms and symmetrical with respect to the longitudinal plane of symmetry α, are connected, at such a plane, through a depression that sinks in the central portion (4), and wherein the junction of said depression has a radius of curvature i such that $0.60*c<i<0.74*c$.

12. The device according to claim 11, wherein the maximum extension a of the device along the transverse plane is $7.8*c<a<9.52*c$.

13. The device according to claim 12, wherein the maximum extension b of the device along the longitudinal plane is $6*c<b<7.32*c$.

14. The device according to claim 13, wherein the thickness of the plate-shaped metal element is uniform for its development and such that $0.1*c<s<0.25*c$.

15. The device according to claim 1, wherein each curved arm is provided with a corresponding hole.

16. The device according to claim 1, wherein from each of two consecutive arms and symmetrical with respect to the longitudinal plane of symmetry (a), at the respective ends, a metal plate, protrudes, orthogonally to the plate-shaped element, wherein each one of said metal plates is welded to the plate-shaped element and each one includes a hole.

17. A structure comprising a first and a second wall that are connected by a device according to claim 1.

18. The structure according to claim 17, wherein at least one of said first and second wall comprises a wood wall.

19. The structure according to claim 17, further comprising elements fastening the device and at least one wall.

20. The structure according to claim 19, wherein said fastening elements comprise threaded fastening elements.

* * * * *